US008833353B2

(12) United States Patent
Cho

(10) Patent No.: US 8,833,353 B2
(45) Date of Patent: Sep. 16, 2014

(54) AIR GUN FIRING OPERATING SYSTEM

(71) Applicants: Chao-Hsiung Cho, Taipei (TW); Nelson Siu Kau Lau, Richmond (CA); Stanley Shu-Wing Lam, Vancouver (CA); Jacky Yau Yu Chan, Vancouver (CA)

(72) Inventor: Chao-Hsiung Cho, Taipei (TW)

(73) Assignees: Chao-Hsiung Cho, Taipei (TW); Nelson Siu Kau Lin, Richmond B.C. (CA); Stanley Shu-Wing Lam, Vancouver B.C. (CA); Jacky Yau Yu Chan, Vancouver B.C. (CA)

( * ) Notice: Subject to any disclaimer, the term of this patent is extended or adjusted under 35 U.S.C. 154(b) by 0 days.

(21) Appl. No.: 13/770,844

(22) Filed: Feb. 19, 2013

(65) Prior Publication Data

US 2013/0319389 A1 Dec. 5, 2013

Related U.S. Application Data

(63) Continuation-in-part of application No. 13/075,738, filed on Mar. 30, 2011, now abandoned.

(30) Foreign Application Priority Data

Dec. 28, 2010 (TW) ..... 99146215 A

(51) Int. Cl.
*F41B 11/70* (2013.01)
*F41B 11/72* (2013.01)
*F41B 11/721* (2013.01)

(52) U.S. Cl.
CPC ..... *F41B 11/70* (2013.01); *F41B 11/72* (2013.01); *F41B 11/721* (2013.01)
USPC ..... 124/73

(58) Field of Classification Search
USPC ..... 124/31, 36, 73, 74, 75, 76, 77; 42/69.01, 69.02, 69.03; 89/128, 132, 89/136, 139
See application file for complete search history.

(56) References Cited

U.S. PATENT DOCUMENTS

| | | | | |
|---|---|---|---|---|
| 3,236,154 | A * | 2/1966 | Iwashita | 89/128 |
| 4,891,898 | A * | 1/1990 | Houseman | 42/69.02 |
| 5,852,891 | A * | 12/1998 | Onishi et al. | 42/69.01 |
| 6,302,092 | B1 * | 10/2001 | Juan | 124/31 |
| 6,550,468 | B1 * | 4/2003 | Tippmann, Jr. | 124/71 |
| 8,033,276 | B1 | 10/2011 | Gabrel | |
| 2007/0151549 | A1 * | 7/2007 | Wood | 124/73 |
| 2011/0232618 | A1 * | 9/2011 | Gabrel | 124/73 |
| 2013/0319389 | A1 * | 12/2013 | Cho | 124/73 |

* cited by examiner

*Primary Examiner* — Bret Hayes
(74) *Attorney, Agent, or Firm* — Muncy, Geissler, Olds & Lowe, P.C.

(57) ABSTRACT

An air gun firing operating system that uses compressed air to eject bullets by a purely mechanical device, and enables single firing or high-speed continuous firing. During the firing operation, the system uses a sliding shuttle tube that is able to slide back and forth in a linear displacement on a central axis between a bullet chamber and a cylinder. The sliding shuttle tube uses differential pressure variation in a pressure buffer chamber to achieve a stroke state that can be continuously changed, thereby achieving high-speed back and forth motion and continuous firing of bullets. The relevant driving position of a trigger device is provided with a sliding retainer, which is able to effect transient retaining of the sliding shuttle tube, thereby restricting the system for single firing, or discontinuing the retention to enable the system to be in a continuous firing operation state.

5 Claims, 7 Drawing Sheets

AIR GUN FIRING OPERATING SYSTEM

RELATED APPLICATION

This application is a Continuation-In-Part of co-pending U.S. application Ser. No. 13/075,738 filed on Mar. 30, 2011, for which priority is claimed under 35 U.S.C. §120; and this application claims priority of Application No. 099146215 filed in Taiwan, R.O.C. on Dec. 28, 2010 under 35 U.S.C. §120; the entire contents of all of which are hereby incorporated by reference.

BACKGROUND OF THE INVENTION (a) Field of the Invention

The present invention provides an air gun firing system, which is able to employ a purely mechanical system to achieve a high speed continuous firing or single firing operation. The firing system uses a sliding shuttle tube able to move frontward and rearward between a bullet chamber and a cylinder. The sliding shuttle tube is subjected to a differential pressure variation of a pressure buffer chamber pressure source during the back-and-forth motion thereof, which changes the stroke direction of the sliding shuttle tube, and the accumulation and discharge operation causes the pressure of the pressure buffering chamber to be in a pulsed mode. The sliding shuttle tube is pushed outward when the pressure is high, and a returning arch force of an arch returning spring pushes the sliding shuttle tube back to its original position when the pressure is low. After repositioning, high pressure is again built up in the pressure buffer chamber, and the sliding shuttle tube is again propelled outward, thereby achieving a continuous back-and-forth striking motion. Furthermore, the speed of the back-and-forth movement is further subjected to an increase in the amount of air pressure in a prepositioned pressure regulating device of the pressure buffer chamber, thus enabling high-speed movement and achieving a high-speed firing operation. In addition, the intervention of a sliding retainer fitted to a trigger device enables restricting the system to a single firing operation.

(b) Description of the Prior Art

Pressurized air guns fire paint balls or BB balls during use thereof, and the source of the air pressure is compressed air. After regulating the pressure of the gun, an instantaneous high pressure enables firing of the bullet. There are two methods of firing, namely single firing and continuous firing. As for the continuous firing mode, this is commonly determined by electronic solenoid valve operation of an air blast. However, this solenoid valve is frequently subjected to change in pressure value of the pressure source, causing a change in the working condition and resulting in malfunction of the system. The reason for which is that when the valve body of the solenoid valve has the shape of a valve pin, and if the air pressure flowing through the solenoid valve is too large, then the surface of the valve pin driven by electromagnetic force will form different angled oblique force components. Furthermore, if the value of the force components is greater than the electromagnetic force, then movement of the suppressed valve pin is caused to fail. Moreover, the solenoid valve is used for the purpose of high speed firing, and, in general, the method used adopts a device fitted with a circuit board provided with a transistor switch, and the device is acted on by a relay circuit operated by the gun trigger to effect a trigger action, thereby enabling electronic switching elements to easily effect high frequency operation to achieve high speed firing of bullets. However, it is common for the circuit board to be often sold without warranty of parts. The reason for which is very simple, because the circuit board is unable to withstand mechanical vibration forces, and high-speed firing effects high-frequency movement which very easily damages the circuit board. Therefore, the circuit boards are also commonly seen as single units that are designed as kits which can be easily assembled to guns, thereby providing easy and rapid replacement and, because of the unfavorable affect of vibration on the circuit enable covering up a visible firing control device of the circuit board from the user. Hence, such a design is really not appropriate for use in high vibrating guns.

Moreover, the circuit needs a power supply to operate, and it is common for a user to forget to turn off the power supply after finishing their game activities, thereby causing the power supply to completely drain after the gun has been put away for about 3 to 5 days (varying depending on power consumption).

Related electronic control problems are really not suitable for actual needs, and many designs have abandoned the continuous firing operation, instead adopting a design whereby the finger is used to effect a pulling action on the trigger to effect a single shot operation, such as Gabrel's U.S. Pat. No. 8,033,276. In FIGS. 1, 12, 19, 21 of said patent, it can be seen that the firing operation drives a valve rod through a synchronous operation mode using a trigger, and uses axial displacement of the valve rod to change the high pressure airflow direction, which determines whether or not there is pressing on a plunger, thereby completing the firing operation. However, when the finger pulls the trigger, the action of the finger muscles are unable to meet the firing speed of a real gun, and is thus assisted with a design having a circuit board able to operate a solenoid valve at high frequency, which enables a pressure system to effect a firing operation at high frequency, as shown in FIGS. 9 and 36 of the patent.

Regarding the pressure accumulation time interval in the storage chamber of said patent, pressure is released after the cylinder is pushed out, forming a low-pressure space enabling an opportune shift-in of a valve portion therein, after which, because the position of the valve spool of the valve portion has changed, thus, the external portion of the gun is caused to channel in high-pressure air, and only then is the gun able to replenish the passageway. Moreover, the high-pressure device is disposed to match the storage chamber, thus, the design of the accumulated pressure operation of the storage chamber of said patent is such that the accumulated pressure time interval of the storage chamber is inevitably spent or occupied by the intervention of the valve portion during the stroke of the valve portion action. Hence, when using a high frequency firing control circuit configuration, the pulse frequency of the storage chamber is unable to keep up with the circuit board firing control frequency, and is unable to reach the tempo of continuous firing, or, because the pulse points and the operating points of the circuit controlling firing are not synchronized, even in a state whereby there is an elementary error in the time points, and under the conditions of an external pressure source maintaining a certain pressure value supply, the storage chamber still does not have the full likelihood of achieving an accumulated pressure state having the appropriate high value. thus causing a weakening of the firing pressure. The reason for which is because of the required time interval for the accumulated pressure, a portion being occupied by the working time of the action of the valve portion. Moreover, in order to prevent air admission and the opening-up of a ventilation action, because the structure of the valve portion causes the high-pressure air to flow from the outside into the path of the storage chamber and forms a critical time for an opening and closing action, both of which can occur in the flow path and the feedback pressure negatively affected by air flowing in different directions, thus, the required positive pressure is canceled out. At that time, an opposite acting force acts on the storage chamber through opening and closing of the valve portion, especially at the moment of the closing action, thereby enabling the nullified storage chamber to obtain the highest pressure value. Accordingly, it is difficult to meet the demands for a strong force and high-speed continuous firing.

Furthermore, in such a prior art design, it can be clearly seen that the accumulated pressure action of the storage chamber is necessarily acted on by the link rod directly joined to the trigger, or determined by whether or not the valve pin is indirectly hit out via a linkage operation through the operation of the circuit board, thereby changing the pressure airflow path through axial displacement of the valve pin and determining the firing action and accumulated pressure operation of the storage chamber. Hence, it is clear that if the trigger system is removed, then the valve pin forms a normally open state, under which conditions the storage chamber is then fixed in a continuously replenished state whereby the storage chamber continuously obtains pressure from an external pressure source (air cylinder). Accordingly, even if the cylinder of the storage chamber is pushed back to correspond therewith based on directional repositioning of a tension spring fitted on its circumference, the cylinder is again subjected to the pressure of the storage chamber and the external pressure source (which has not yet undergone pressurization) and further pushed out towards the firing direction. Although the cylinder at this time is seemingly effecting a continuous back-and-forth action, however, its displacement travel distance is extremely short, and is unable to travel a withdrawal distance sufficient to enable filling the space with bullets. Therefore, the storage chamber simply can not accumulate pressure, and thus does not have the required energy capacity for firing to occur.

Although the aforementioned removal trigger system is not suitable for a trigger operated gun firing simulation, however, if designed for guns with the requirement for continuous firing, then its is difficult for the system design of said patent to effect the capacity to realize such an operation.

SUMMARY OF THE INVENTION

A primary objective of the present invention is to provide an improved air gun that achieves stable high-pressure continuous firing, which, under stable physical conditions, allows a uniform pulse type continuous blast of air pressure for firing of bullets, or uses the restrictive function of a trigger device to intervene and restrain the system to operate in a single firing mode or be used as a safety lock.

A second objective of the present invention lies in using a sliding shuttle tube to achieve the aforementioned objective, in which the interior of the sliding shuttle tube is coaxially fitted with a sliding column, the outer circumference of which is slidably disposed in a bullet chamber, and the internally fitted sliding column is slidably disposed in a cylinder body fitted in a cylinder fixedly joined to the main body of the gun. Unidirectional repositioning of the sliding shuttle tube is realized by means of an arch returning spring, and compressed air conveyed by the cylinder acts on the sliding column, thereby causing the sliding shuttle tube to move toward the bullet chamber. After the end surface of the sliding column separates from the cylinder body, then the cylinder body comprises a pressure buffer chamber containing the entire compressed air, which propels a bullet by means of the sliding shuttle tube to achieve the firing objective. After the pressure drops, the arch returning spring prepares to push back and reposition the sliding shuttle tube, thereby achieving a continuous motion operation.

A third objective of the present invention lies in using a trigger device, which drives a sliding retainer by means of a cam. The sliding retainer subjects the sliding shuttle tube to a transient line of motion to achieve a single firing function or can be opened for continuous firing or for safety locking.

A fourth objective of the present invention lies in the cylinder connected to an air pressure regulating system, in which the air pressure regulating system is installed with a pressure regulating device and an overpressure protection device and a flow control device, whereby regulation of the inflow of compressed air is carried out to stabilize pressure and protect against overpressure, thereby avoiding the risk of bullets traveling too fast during firing and endangering the environment or the gun structure.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
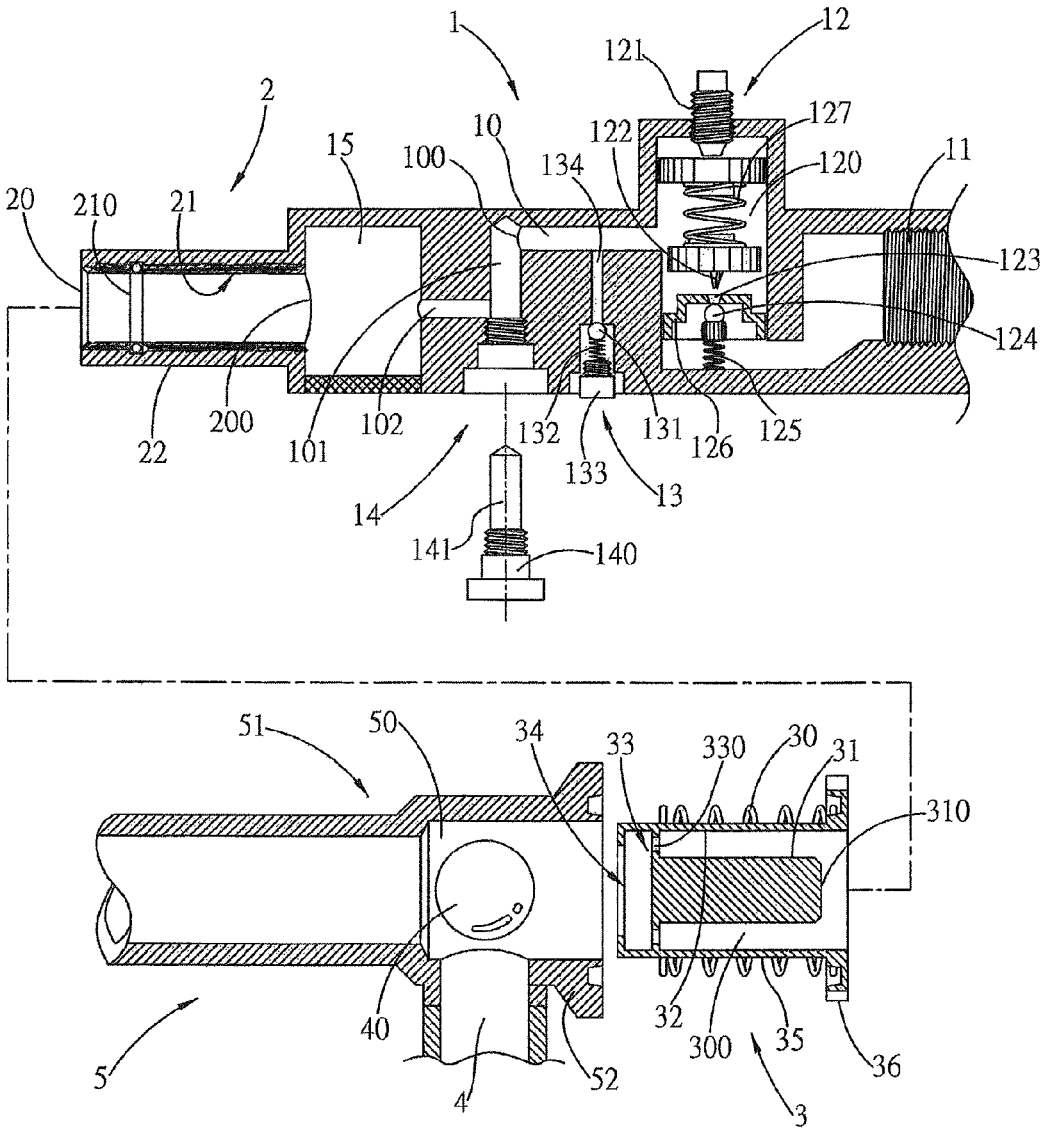
FIG. 1 is a front and rear dispositional view of the system of the present invention.

Referring first to FIG. 1, the present invention primarily comprises a sleeve-shaped sliding shuttle tube 3. The interior of the sliding shuttle tube 3 is fitted with a sliding column 31, and the sliding column 31 is disposed to slide on a cylinder body 21 fitted in the center of a cylinder 2. A shuttling outer circumferential surface 35 of the sliding shuttle tube 3 is disposed to slide in the inner circumference of a cylinder-shaped bullet chamber 50 that is connected and fixed to a gun barrel 5. A sliding inner circumferential surface 32 of the sliding shuttle tube 3 is further slidably mounted on a cylindrical outer circumferential surface 22 of a cylinder 2, causing a movable airtight tolerance to be formed between the sliding column 31 and the cylinder body 21 and between the sliding inner circumferential surface 32 and the cylindrical outer circumferential surface 22. Moreover, such a configuration forms a mutually coaxial (the working shaft of the firing action) socket combination relationship. The sliding shuttle tube 3 is then supported by the cylinder 2 and the bullet chamber 50 fixed to the gun body, and enables achieving a back-and-forth displacement on an axial line position.

A bullet 40 is caused to enter the bullet chamber 50 through a bullet loading opening 4, in which the bullet 40 enters so as to be aligned with the center position of a gun chamber 51. The bullet chamber 50 is provided with a pressing ring 52 facing the expanded open side periphery of the cylinder 2, and the pressing ring 52 enables pressed assemblage to a corresponding end of an arch returning spring 30, in which the arch returning spring 30 generates the push-back power to push the sliding shuttle tube 3 toward the direction of the cylinder 2.

One end of the sliding shuttle tube 3 mounted on the cylinder 2 is outwardly widened to form a ring-shaped retaining shoulder 36, and one side of the retaining shoulder 36 corresponding to the pressing ring 52 similarly compresses an end opening of the arch returning spring 30.

The base of the sliding column 31 of the sliding shuttle tube 3 connects to a radial connecting portion 33 to form a suspended rod form, and the connecting portion 33 is a pressure feed opening 34 directed toward the end opening of the firing direction. Passageways are realized between the pressure feed opening 34 and a tube-shaped chamber 300 of the sliding shuttle tube 3 through air holes 330 defined in the connecting portion 33. The length of the sliding column 31 is shorter than the overall length of the sliding shuttle tube 3, and an end surface 310 thereof is positioned within the range of the axial length of the tube-shaped chamber 300.

The cylinder body 21 is fitted in the interior of the cylinder 2, and the cylinder body 21 is radially fitted with a compression ring 210. The elastic effect of the compression ring 210 is used to further improve the airtight effectiveness of the aforementioned sliding column 31.

The cylinder body 21 of the cylinder 2 is linked in the direction of an air pressure regulating system 1, and the cylinder body 21 first enables channeling to a pressure buffer chamber 15 of the air pressure regulating system 1, the pressure buffer chamber 15 then enables channeling to a channeling portion 11 through the air flow path. In order for the channeling portion 11 to accept the intake of the compressed air source, after intake of the compressed air by the channeling portion 11, the compressed air is first adjusted using a pressure adjusting device 12, which is able to adjust the magnitude of the pressure value. Adjustment can be achieved by transferring pressure to the outside using an adjusting screw 121, while an overpressure protection device 13 fitted in the path is able to automatically release excessive pressure. Moreover, a flow control device 14 can be fitted in the path for fast adjustment, whereby adjustment of the flow control device 14 enables changing the speed relationship, thereby forming a pressure effect in the interior of the pressure buffer chamber 15.

The cylinder 2 of the aforementioned cylinder body 21 is provided with a first opening end 20 facing the working end thereof, and toward the rear end is a second opening end 200. The mouth edge of the second opening end 200 adjoins and affords passage to the inner surface of one side joined to a pressure buffer chamber 15 using an intersecting method, thereby enabling the compressed air of the pressure buffer chamber 15 to rapidly replenish the cylinder body 21. The pressure buffer chamber 15 is indirectly connected to a channeling portion 11 of a high pressure air cylinder via a replenishment flow path 102 and a channeling device.

With respect to channeling of the replenishment flow path 102 toward the direction of the channeling portion 11, the replenishment flow path 102 is first channeled and joined to one end of a valve opening 101 positioned in the interior of the main body of the pressure regulating system 1. Another end of the valve opening 101 affords passage to an interpassage flow path 10. The size of the space of the valve opening 101 is caused to change by the intervention of an adjusting screw 140 fitted to a flow control device 14, thereby interfering with the flow in the interpassage flow path 10 flowing to the pressure buffer chamber 15. The interference method uses the externally adjustable adjusting screw 140 to effect an externally directed end opening screw relationship with the valve opening 101. The adjusting screw 140 is coaxially fitted with a valve rod 141 corresponding to the spatial form of the valve opening 101. After the adjusting screw 140 has effected an external rotating operation on the valve rod 141, then longitudinal displacement occurs thereof, and the amount of change in the displacement changes the relative amount of clearance between the outer surface and inner surface of the valve rod 141. The amount of clearance, namely the change in the through-flow area of a valve opening 100, thereby regulates the flow quantity of the interpassage flow path 10 flowing toward the direction of the pressure buffer chamber 15, and this change in the flow quantity is further used to enable the state of the pressure buffer chamber 15 to form an accumulated pressure value (a prerequisite being that the cylinder body 21 is blocked by the sliding column 31 of the sliding shuttle tube 3) in the pressure buffer chamber 15. The change in pressure value is then able to regulate the firing rate of bullet bodies 40 being fired.

In addition, an overpressure protection device 13 can be fitted in the flow path system toward the exterior of one side of a section of the interpassage flow path 10, with the overpressure protection device 13 affording passage to a pressure release passage 134. The overpressure protection device 13 mainly comprises one end which is fixed by being screwed and locked down to the main body of the pressure regulating system 1 using a locking screw 133. The inner end surface of the overpressure protection device 13 is supported by a free end top pressing steel ball 131 fitted to a safety spring 132. In a normal state, the pressing steel ball 131 blocks the end opening of the pressure release passage 134. If the air pressure flowing through the interpassage flow path 10 reaches the safety threshold set by the system, then the pressure is directed toward the direction of the pressure release passage 134, and the pressure pushes against the pressing steel ball 131, thereby achieving the safety objective of causing the release of the overpressure in the system. The vertical height of the locking screw 133 can be adjusted by means of a screw bolt method, and when the locking screw 133 has been inwardly tightly fastened, then the safety spring 132 is able to store even greater elastic stress, thereby having the force to press up against the pressing steel ball 131, whereupon the interpassage flow path 10 is able to retain air at an even higher pressure. Apart from depending on regulation of the overpressure protection device 13 to change the pressure safety limit of the system, the overpressure protection device 13 also similarly determines the pressure state of the pressure buffer chamber 15.

A pressure regulating device 12 is indirectly fitted between the interpassage flow path 10 and the channeling portion 11. The components of the pressure regulating device 12 are able to more efficiently regulate the resultant pressure required within the system, and provide a role for the air pre-expanding space. The pressure regulating device 12 is fitted with a regulating cylinder body 120. One end of the regulating cylinder body 120 affords passage to the channeling portion 11 through a flow switching valve 126. The flow switching valve 126 is provided with a pinhole 123 parallel to the linear direction of air flow drainage. The pinhole 123 is sealed with a valve ball 124 towards the end opening of the channeling portion 11. The valve ball 124 is supported by the tensile force produced by an arch pressure spring 125 of the pressure regulating system 1 pressing up against thereof, thereby producing a sealing action on the pinhole 123. The system of the pressure regulating device 12 is fitted with an adjusting screw 121 able to effect external adjustment which acts on a tension spring 127. The tension spring 127 is linked to a valve needle 122 corresponding to the position of the pinhole 123. The upper and lower height position of the of the valve needle 122 is changed by adjustment by the adjustment screw 121, and the further coefficient intervention of the tension spring 127 produces a force which pushes downward on the valve ball 124. Provided that the force applied by the valve pin 122 causes the valve ball 124 to withdraw, then the compressed air of the channeling portion 11 is able to pass through the pinhole 123 and fill the interior of the regulating cylinder body 120. A pre-expanding pressure boost is thus effected, after which the compressed air can be continuously supplied through the interpassage flow path 10, and indirectly transmitted to the pressure buffer chamber 15 through the flow control device 14.

Under the aforesaid circumstances, the pressurized air supplied through the channeling portion 11 is able to uninterruptedly fill the interior of the pressure buffer chamber 15 with air. And because of the firing action, apart from pressure being expended in the space of the pressure buffer chamber 15, the pressure buffer chamber 15 is continuously maintained in a high-pressure state. This point has a completely different application function compared to prior art designs.

Summarizing the aforementioned rationale, the present invention only needs the channeling portion 11 to import high pressurized air pressure to achieve the ability to enable driving a completely mechanical firing operating system without fitting any mechanical or electro-mechanical firing control device, as depicted in FIGS. 2 to 5. The present invention eliminates the need for any firing control device, and only uses the before and after differential pressure in the system to naturally achieve a continuous firing action. Hence, the system of the present invention can be applied in guns only having the simple needs for continuous firing. In addition, in order for the system to provide the function to enable using the finger to pull the trigger to achieve a single shot, then the system needs to be fitted with a trigger device 7 as depicted in FIG. 6, and only then can it achieve a single firing operation. This point is a completely different functional design compared to the design of the aforementioned prior art, and also a noticeably different application concept.

Figure 2:
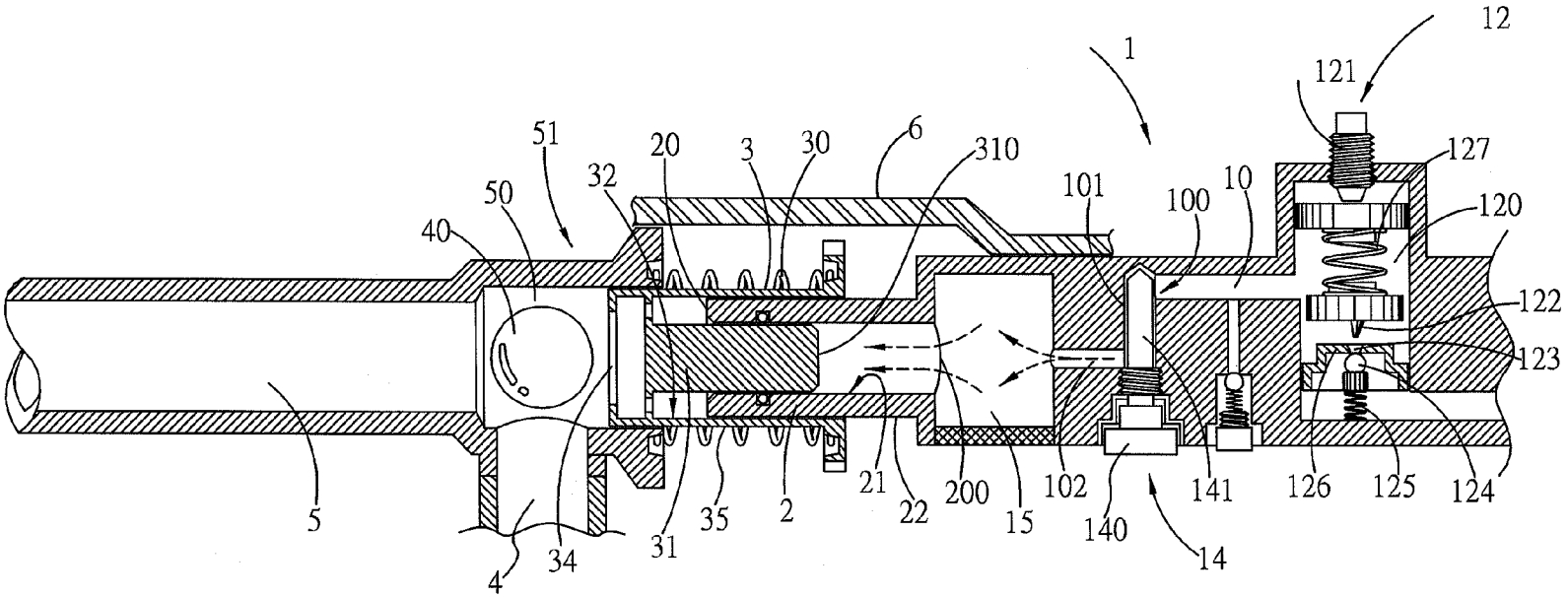
FIG. 2 is a configurational view of the structural relationship before firing of the system of the present invention.

Referring to FIG. 2, the gun barrel 5 is coupled to the air pressure regulating system 1 by means of a barrel component 6, the barrel component 6 being one part of the barrel, and the gun barrel 5 and the air pressure regulating system 1 form a coaxial linear relationship front-rear assembly. The sliding shuttle tube 3 is coaxially, disposed so as to slide on the cylinder 2, and the cylinder 2 is joined to the air pressure regulating system 1 to connectively channel air pressure from the pressure buffer chamber 15. The bullet chamber 50 of the gun barrel 5 enables the shuttling outer circumferential surface 35 of the sliding shuttle tube 3 to be slidably disposed thereon, and the side feeding bullet loading opening 4 enables loading into the sliding shuttle tube 3. Joining of the barrel component 6 causes a coaxial linear assembly to form between the gun barrel 5 and the cylinder 2, thereby enabling the sliding shuttle tube 3 to rely on the linear support of the bullet chamber 50 and the cylinder 2 to produce a back and forth motion, and the arched pressure of the arch returning spring 30 is used to push back and effect restoring of the sliding shuttle tube 3. During the pushing back process, the end surface 310 of the sliding column 31 effects damping in the direction of the pressure buffer chamber 15.

Before a firing operation, the compressed air of the pressure buffer chamber 15 acts on the end surface 310 of the sliding column 31, and the sliding column 31 connectively drives the shuttling outer circumferential surface 35 by means of the sliding inner circumferential surface 32, whereupon, the bullet chamber 50 slides into the gun barrel 5, and the arch returning spring 30 is simultaneously compressed. The compressed air of the pressure buffer chamber 15 successively acts on the sliding column 31 of the sliding shuttle tube 3, thereby causing the entire sliding shuttle tube 3 to be displaced toward the bullet chamber 50. At this time, the compressed air remaining in the cylinder body 21 of the cylinder 2 and the end surface 310 forms an internal space with the sliding column 31, and the sliding shuttle tube 3 is squeezed to finally retain the bullet 40.

The aforementioned detailed operation entails the pressure regulating device 12 importing air from the exterior thereof through the pinhole 123 of the flow switching valve 126, and the pre-expansion pressure that occurs fills the interior of the regulating cylinder body 120. The adjusting screw 121, as described above, serves to effect the primary adjustment of the system resultant pressure. The pressure produced by the regulating cylinder body 120 passes through the interpassage flow path 10, whereupon the flow control device 14 indirectly regulates the flow quantity, after which, the air is channeled through the replenishment flow path 102 toward the direction of the pressure buffer chamber 15 and continuously supplies and fills the interior of the pressure buffer chamber 15 (FIG. 2 depicts one of the action states before firing). The high pressure air of the pressure buffer chamber 15 seeks an outlet and presses an end surface 310 of the sliding column 31, thereby causing the sliding column 31 to be pushed toward the direction of the gun barrel 5, at which time the position of the end surface 310 of the sliding column 31 is still maintained within the range of the longitudinal length of the cylinder body 21 of the cylinder 2. Moreover, at this time, the air pressure consumed by operation of the pressure buffer chamber 15 is also replenished by a continuous supply from the replenishment flow path 102.

Figure 3:
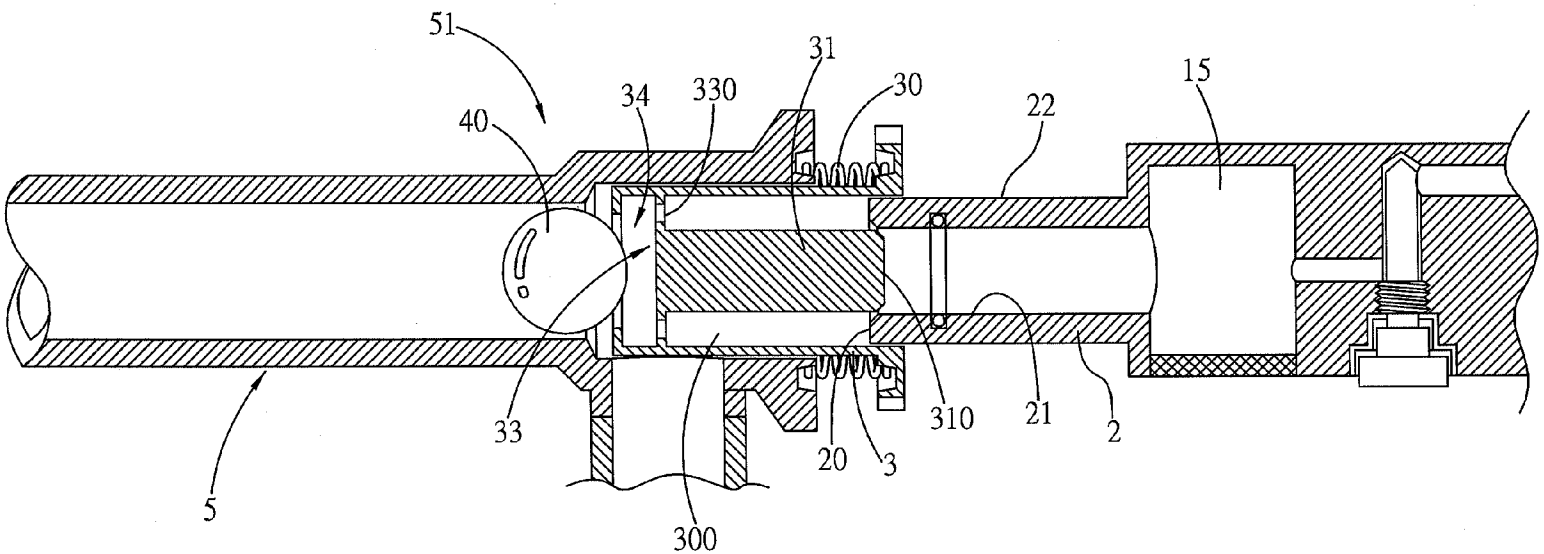
FIG. 3 is a configurational view of the structural relationship of critical points before firing of the system of the present invention.

FIG. 3 depicts the end surface 310 of the sliding column 31 receiving the pressurization of the pressure buffer chamber 15, thereby connectively displacing the entire sliding shuttle tube 3. The pressure feed opening 34 of the sliding shuttle tube 3 contains the circular shearing surface of the bullet 40, and pushes the bullet 40 causing it to be positioned in the inner end of the gun barrel 5. The arch returning spring 30 is subjected to extreme compression, and the end surface 310 almost separates from a first opening end 20 of the cylinder 2. At this time, the first opening end 20 also passingly channels the extraneous air through the breadth of a connecting portion 33 of the pressure feed opening 34, where the air passes through air holes 330 and replenishes air by taking in extraneous air outside of a gun chamber 51 to achieve the requirement to fill out the internal volume space of the first opening end 20.

Figure 4:
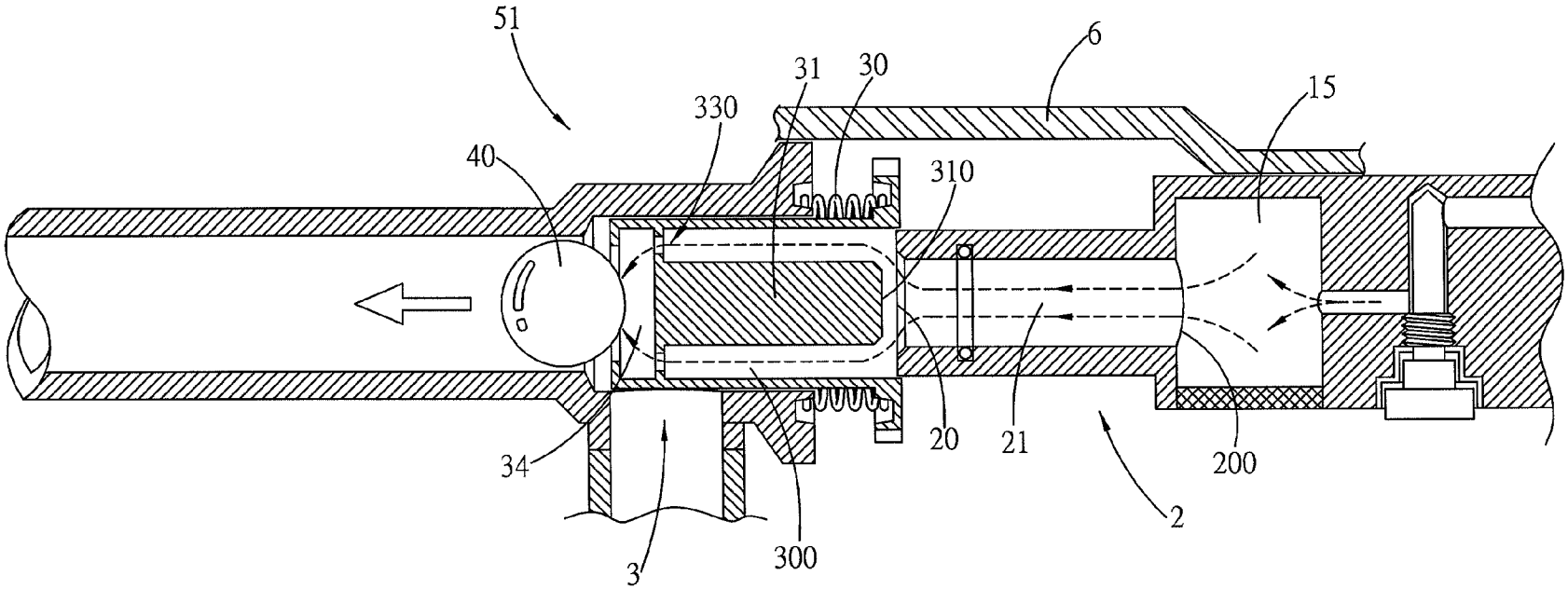
FIG. 4 is a schematic view of the configuration of the relevant positions of the various critical components of the present invention.

Referring to FIG. 4, pressure from the pressure buffer chamber 15 continues to act on the sliding column 31 of the sliding shuttle tube 3, and after the end surface 310 of the sliding column 31 is pressed to separate from the first opening end 20 of the cylinder 2, then compressed air of the pressure buffer chamber 15 is conveyed toward the tube-shaped chamber 300 of the sliding shuttle tube 3 through the cylinder body 21 of the cylinder 2, further passing through the air holes 330 of the tube-shaped chamber 300 of the sliding shuttle tube 3 and being completely channeled into the pressure feed opening 34, whereupon instantaneous collapse of the compressed air is realized, and the bullet 40 is ejected from the bore of the gun 51, at which time instantaneous squeezing causes internal air pressure of the tube-shaped chamber 300 of the sliding shuttle tube 3 and the cylinder body 21 of the cylinder 2 to be instantaneously released.

Figure 5:
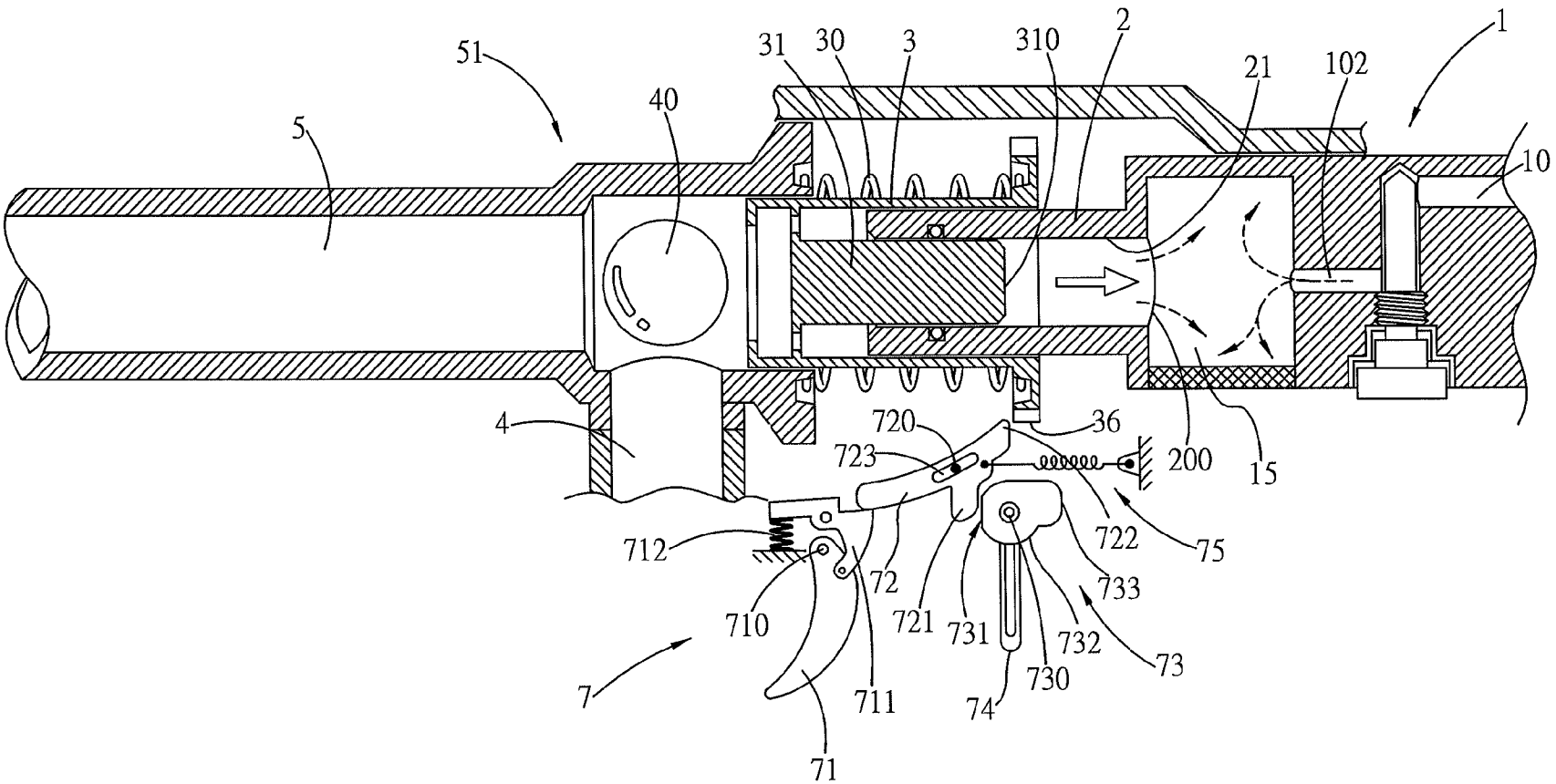
FIG. 5 is a schematic view of the system configuration of the present invention after returning of moving components to original positions.
Figure 6:
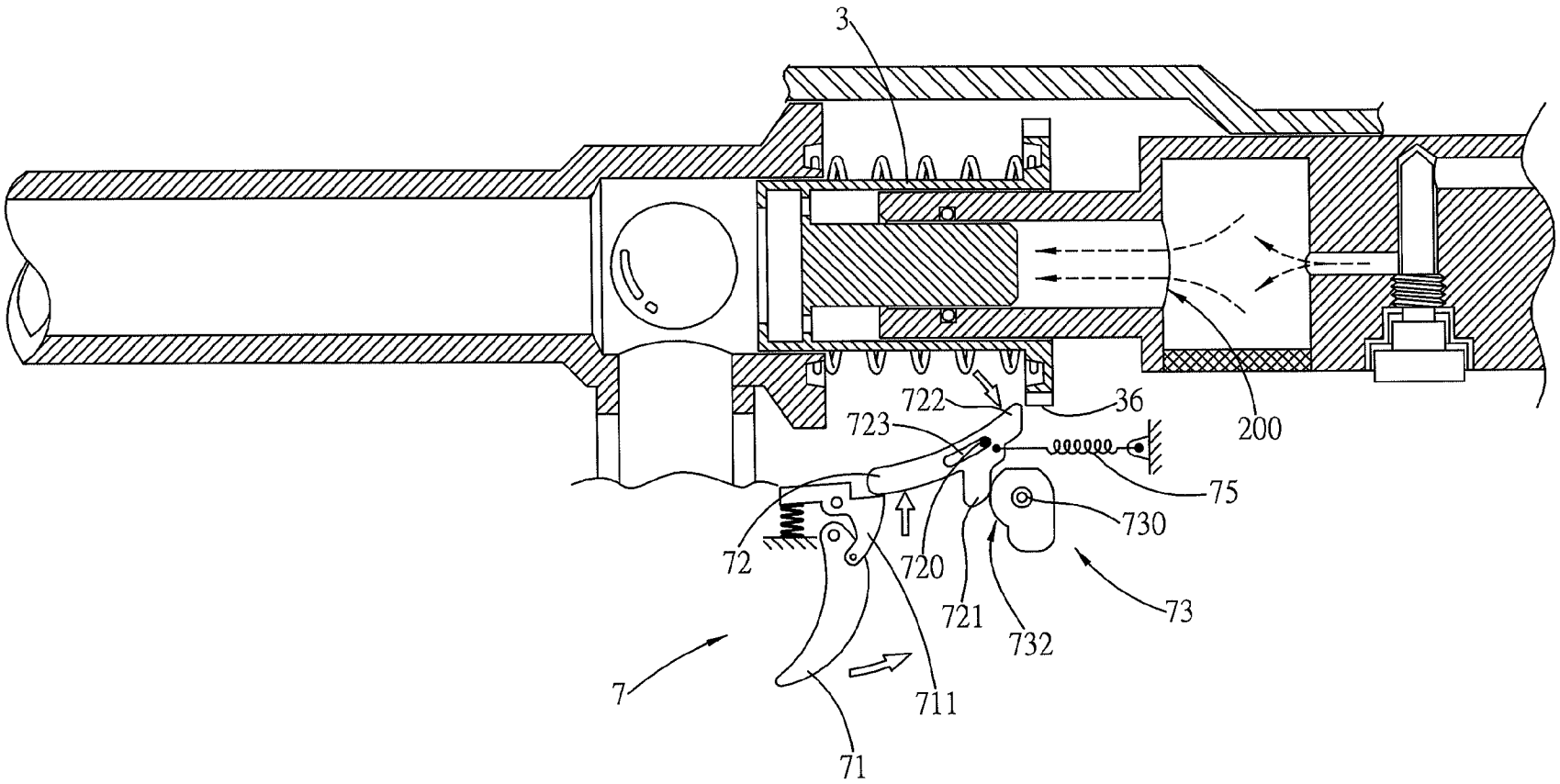
FIG. 6 is a schematic view depicting the configurational view of the structural relationship showing use of the single limit stop-retaining continuous firing of a trigger device of the present invention.

Referring to FIG. 5, because of the pressure drop after the aforementioned release of the internal air pressure, thus, arch pressure of the arch returning spring 30 is used to push back the sliding shuttle tube 3 toward the cylinder 2. During the process of pushing back, the end surface 310 of the sliding column 31 forms an additional pressure by means of the limit relationship of the cylinder body 21 during the process of backing up, and restores it back in the pressure buffer chamber 15 ready for firing again.

Under unrestricted movement of the sliding shuttle tube 3, the aforementioned firing process enables back and forth continuous running of the sliding shuttle tube 3 to allow the bullets 40 to be continuously ejected, in which the successive bullets 40 are continuously loaded into the bullet loading opening 4. As long as the bullet loading opening 4 is filled with a quantity of the bullets 40, and the sliding shuttle tube 3 is able to continuously move back and forth, then a continuous firing operation is achieved. The aforementioned operations are all mechanical movements, and as long as these movements are not subjected to external force causing interference therewith, then a continuous firing operation is achieved.

As described above, the system of the present invention is able to achieve the principle of a self-operated continuous firing operation, and is based on the rapid drop to a low pressure value in the pressure buffer chamber 15 after the firing operation. However, the elastic energy of the arch returning spring 30 is able to drive the repositioning of the sliding shuttle tube 3, and the sliding column 31 fitted on the repositioning linkage axis of the sliding shuttle tube 3 is pressed towards the direction of the pressure buffer chamber 15, thereby plugging the cylinder 2. Moreover, a portion of air pressure is replenished back into the pressure buffer chamber 15 through the area effect of the end surface 310 of the sliding column 31 during the return-stroke action thereof, and at the same time, the pressure buffer chamber 15 continues to receive the high-pressure air supplied by the replenishment flow path 102 during the return-stroke action of the aforementioned sliding shuttle tube 3. Similarly, the replenishment flow path 102 uninterruptedly continues to supply high pressure air to the pressure buffer chamber 15. This point is dissimilar to the operation mode of the control replenishment timing of the prior art.

The main source of the pressure required by the pressure buffer chamber 15 is obtained from the replenishment flow path 102, and no intermittent switching operation device (such as the spool valve of the prior art described above) of any kind is fitted in the channel path of the replenishment flow path 102 toward the channeling portion 11 (as shown in FIG. 1). Hence, apart from a falling in pressure in the pressure buffer chamber 15 of the system of the present invention at the instant of firing, at other times during the operating process, as long as the channeling portion 11 channels in pressure from an air cylinder, then the space of the pressure buffer chamber 15 stores highly compressed air when ever necessary. Moreover, the pressure difference between the high pressure value of the compressed air and the pressure value at the instant of firing generates a differential pressure. The system of the present invention uses the differential pressure to achieve system operation, whereby, when the system is at low pressure, the sliding shuttle tube 3 performs a return-stroke, and when at high pressure, a firing action pushes against the sliding shuttle tube 3. In such a way, the system uses repeated variation in differential pressure to achieve an automatic continuous firing operation. Accordingly, there is no need for an external device to preside over continuous operation of the system. This point is a completely different concept compared to that of the prior art. Moreover, the present invention simplifies the structure for a continuous firing gun by completely replacing the high-frequency continuous firing control circuit board of the prior art. And because the present invention excludes entirely the unnecessary firing control device, thus, the failure rate of the gun is significantly lowered.

The present invention is purely a mechanical firing operation, and also uses mechanical restrictions to allow the system to provide a choice between being used for single firing or continuous firing. One side of the travel line of the sliding shuttle tube 3 of the present invention is fitted with a trigger device 7 able to cause interference, and functions to restrict the sliding shuttle tube 3, enabling selection of continuous firing to allow continuous movement of the sliding shuttle tube 3 and thereby achieve continuous firing of bullets, or for single firing use by operating a trigger 71 using a transient state restriction.

The trigger device 7 basically comprises the trigger 71, and a triggering operation of the trigger 71 drives a sliding retainer 72. After being acted on by the trigger device 7, a retainer tip 722 of the sliding retainer 72 enables retaining the corresponding end of the retaining shoulder 36 of the sliding shuttle tube 3, and blocking or opening of the retaining shoulder 36 of the sliding shuttle tube is used to achieve selection for continuous firing or single firing operation. In which the trigger 71 is fastened to a fixed position of the gun body by means of a pin 710, and is able to elastically restore its position. When the trigger 71 is pulled, a tripping arm 711 indirectly squeezes the corresponding end of the sliding retainer 72 causing it to turn upward one time around the pin 710 as an axis center point, after which the tripping arm 711 is subjected to the position returning elasticity of the spring 712 and repositioned, while simultaneously connectively moving the trigger 71 to return to its original position.

The sliding retainer 72 is used as a working pivot by means of the pin 720, moreover, the sliding retainer 72 is subjected to the action of a pulling spring 75 to pull it toward the right side and hold the position thereat, and displacement is only produced when subjected to operation of the trigger 71. The sliding retainer 72 is tripped every time the trigger 71 is pulled and produces a horizontal displacement each time, thereby allowing the retainer tip 722 to cause single downward drawing back of the corresponding end surface of the retaining shoulder 36 by means of the axis center support function of the pin 720. Accordingly, the retaining shoulder 36 is released to achieve a firing operation, and the retaining shoulder 36 is subjected to the arching action of the arch returning spring 30, producing a shearing pressure on the upper surface of the retainer tip 722 and repositioning thereof. Moreover, under the condition of not being acted upon by the shearing pressure, the retainer tip again upwardly recoils, after which the retainer tip 722 is restrained through restriction thereof and causes clamping of the sliding shuttle tube 3 after repositioning thereof, forming a transient stoppage, and thereby achieving a single firing function.

The sliding retainer 72 is provided with a kidney shaped hole 723, and the kidney shaped hole 723 enables slidably disposing therein of the pin 720 joined to the gun body, while the linear length of the kidney shaped hole 723 allows two angular rotational movements of the sliding retainer 72, such as left and right or up and down.

The present invention uses the auxiliary function of the trigger device 7, the main reason for which is to realize a single firing function. However, when requiring continuous firing, the trigger device 7 can, in fact, be removed to achieve a continuous firing mode. However, in order to meet the needs of the user with the intention to use the gun for single firing, thus, the present invention is installed with the trigger device 7. After the trigger device 7 is installed, in order to simulate the holding of the trigger of a real gun and thereby similarly produce a continuous firing operating state, then the lower suspended position of the sliding retainer 72 is fitted with a shearing arm 721, and turning of a cam 73 enables restraining the shearing arm 721 to an angular position, thereby determining whether or not the height position of the retainer tip 722 impinges on the retaining shoulder 36. Disposition of the cam 73 involves using a pin 730 to movably fix the cam 73 to the gun body, and a switch stop 74 enables moving angular position thereof. The periphery of the cam 73 is provided with a single firing give way notch 731, and after the shearing arm 721 is pulled by the pulling force of the pulling spring 75, then the single firing give way notch 731 enables maximum position limitation by the shearing arm 721. After changing angular position, the cam 73 is further provided with a continuous firing restraining surface 732, and after changing angular position again, the cam 73 is further provided with a safety locking butt retaining convex protrusion 733. The continuous firing restraining surface 732 provides a restraining function to enable continuous firing, and the butt retaining convex protrusion 733 serves to function as a safety lock.

The working performance of the aforementioned cam 73 is able to use the corresponding operation of purely mechanical components to directly change whether or not the shearing arm 721 effects interference of the retaining shoulder 36, and determines the state of the firing operation. This is completely different from that described in the prior art, which limits a valve pin relative to interference of the through-flow or direction of the flow path.

Regarding implementation of the single retaining continuous firing operation of the device of the present invention, please refer to FIG. 6, in which after the angular position of the cam 73 has been changed, the continuous firing restraining surface 732 thereof tangentially compresses one side of the shearing arm 721 to produce a cam-like pushing effect, thereby shear compressing the corresponding side of the shearing arm 721. The retaining shoulder 36 is originally restrained by the retainer tip 722 to maintain a blocking effect and disable the sliding shuttle tube 3 from moving, and when angular position of the cam 73 is adjusted to allow the continuous firing restraining surface 732 to act on the shearing arm 721, then the sliding retainer 72 is restricted to the shifted down angular position, and the trigger device 7 triggers the corresponding end of the sliding retainer 72 to hold the selection. The pivot function of the pin 720 enables the sliding retainer 72 to cause the retainer tip 722 to maintain a dropped give way state, at which time, the sliding shuttle tube 3 disengages interference with the system, and a continuous back and forth motion is formed, thereby achieving a continuous firing operation. Releasing the trigger 71 causes the retainer tip 722 to again rise and impinge on the retaining shoulder 36, thereby stopping movement of the sliding shuttle tube 3.

The standard principle of the aforementioned continuous firing operation comprises the sliding retainer 72 being displaced by pulling on the trigger 71, whereby after the trigger 71 is released by the finger, then the retainer tip 722 of the sliding retainer 72 is able to upwardly reposition through use of the pulling force of the pulling spring 75 and the support of the pin 720, thereby impinging again on the retaining shoulder 36 of the sliding shuttle tube 3. Moreover, the trigger 71 enables the sliding retainer 72 to maintain a restraining relational position, that is, the shearing arm 721 of the sliding retainer 72 is impinged on by the protrusion of the continuous firing restraining surface 732 and pushed toward the left, at which time, the pin 720 is at the right side of the kidney shaped hole 723 of the sliding retainer 72, and, correspondingly, the remote end of the sliding retainer 72 extends into the upper surface of the tripping arm 711 to be subject to pulling and displacement of the trigger 71, after which the sliding retainer 72 continues to be prompted upward, and through the support of the pin 720, the respective retainer tip 722 is forced to drop to a height that separates it from the interfering with the sliding shuttle tube 3, thereby obtaining the continuous firing operation.

Figure 7:
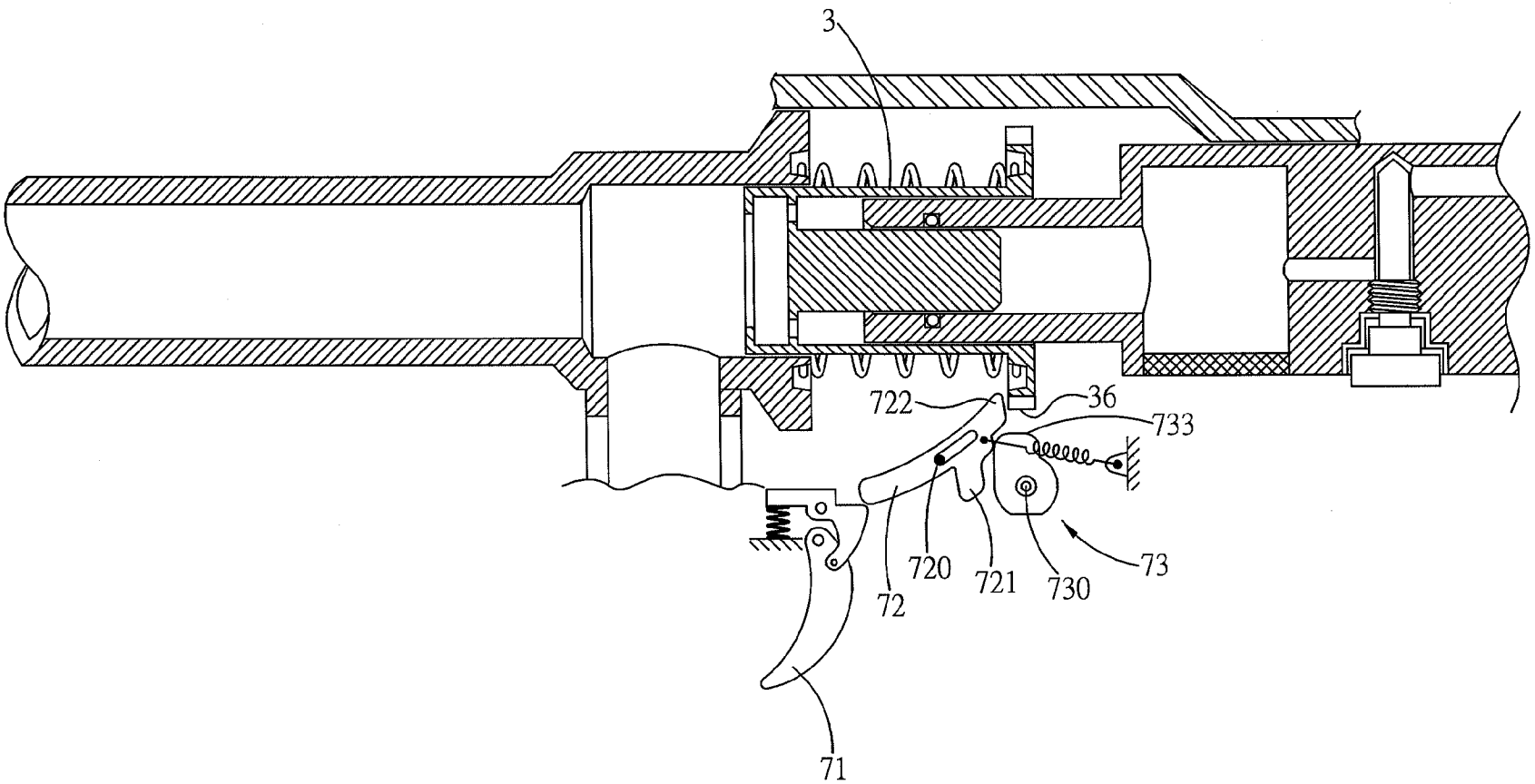
FIG. 7 is a schematic view depicting the configurational view of the structural relationship of a sage locking mechanism of the present invention.

Referring to FIG. 7, which shows disposition of the butt retaining convex protrusion 733 of the present invention, in which, changing the angular position of the cam 73 enables the cam 73 to press and secure the retainer tip 722 of the sliding retainer 72 to maintain an upper position, and further restrains the retaining shoulder 36 of the sliding shuttle tube 3. Moreover, the end of the sliding retainer 72 corresponding to the trigger 71 is further able to relationally compress the trigger 71, thereby restricting the trigger 71. Such a locking state functions as a safety switch as used in general guns.

The present invention basically provides a purely mechanical system enabling a continuous firing operation, and uses the inside and outside of the sliding shuttle tube 3 to form an axial sliding relationship between the front and rear of bullet chamber 50 and the cylinder 2 and the cylinder body 21 of the cylinder 2, whereby, during the process of the sliding shuttle tube 3 mounted and sliding on the cylinder 2, before firing, a critical opening is achieved between the end surface 310 of the sliding column 31 of the sliding shuttle tube 3 and the first opening end 20 of the cylinder 2, thus allowing compressed air from the cylinder body 21 of the cylinder 2 to pass through the air holes 330 provided in the tube-shaped chamber 300 of the sliding shuttle tube 3 and fill the pressure feed opening 34 to fire the bullet 40. After firing, because of the instantaneous drop in pressure, the arched resistivity of the arch returning spring 30 forces back the sliding shuttle tube 3 toward the cylinder 2. Accordingly, repeating the aforementioned pressure operated firing enables achieving a system auto-firing natural continuous operation. In order to simulate single trigger pulling firing, then after the trigger device 7 is pulled and intervenes, such an action on the trigger effects instant point release of single trigger pulling to simulate single firing of a real gun, or single trigger pulling with continuous retention of the trigger to achieve simulation of continuous firing of a real gun, as well as providing safety locking for the firing system of the gun.

The present invention is based on the use of a purely mechanical mechanistic system, but enables the sliding shuttle tube 3 to realize a back-and-forth movement during the process of differential pressure variation in the pressure buffer chamber 15, thereby achieving automatic continuous firing and a pressurized stable operation. and will not malfunction because of changes in pressure difference. Moreover, operation by specific mechanical alteration is further achieved, and in use provides higher reliability and a stable configuration. Furthermore, the pressure adjustment device 12 fitted in the air pressure regulating system 1 portion is used to stabilize the pressure, and under circumstances whereby there is excessive pressure, then release of pressure by the overpressure protection device 13 enables achieving safe control of the amount of firing force. In addition, use of the flow control device 14 enables changing the velocity of flow to regulate the air pressure relationship.

The present invention further uses a completely mechanical firing control system to achieve continuous firing or single firing or single limit stop-retaining continuous firing or complete safe locking of the system, and is clearly an innovation design in the field of air gun design. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An air gun firing operating system providing an air gun using compressed air to eject a bullet, thereby achieving a firing operating system to effect single firing and high-speed continuous firing by purely mechanical working operation, said system comprising:

a pressure regulating system fixed by a main body of the gun, a channeling portion is fitted to the pressure regulating system, and the channeling portion is connected to the pressure regulating system to provide passage toward an interior of the main body of the pressure regulating system; the pressure regulating device is connected to a flow control device through an interpassage flow path, an output end of the flow control device affords passage to a pressure buffer chamber through a valve opening;

a cylinder, a cylinder body is axially fitted in an interior of the cylinder, an exterior of the cylinder and the cylinder body are coaxially conjoined with a cylindrical outer circumferential surface; one end of the cylinder body is provided with a first opening end, a mouth edge of the first opening end is joined to a side surface of the pressure buffer chamber, and another end is provided with a second opening end of the cylinder body;

a sliding shuttle tube that coaxially forms a bushing with the cylinder, an outer circumference of one end of the sliding shuttle tube is expanded and equipped with a retaining shoulder, the other end of the sliding shuttle tube is provided with a pressure feed opening; a conjoined cylindrical sliding inner circumferential surface is formed on an interior of the sliding shuttle tube, and the sliding inner circumferential surface is provided with a connecting portion facing an internal radial position of the pressure feed opening; a center of the connecting portion is joined to a conjoined sliding column facing toward one direction of the retaining shoulder, and the sliding column is provided with an end surface facing the direction of the retaining shoulder; a radial position of the end surface is within a range of a length of the sliding inner circumferential surface; a tubular cylindrical chamber is separated out between an outer circumferential surface of the sliding column and the sliding inner circumferential surface, and a bottom portion of a cylindrical chamber affords passage to a channeling pressure feed opening through air holes provided in the connecting portion;

a cylinder-shaped gun chamber coaxial with the cylinder and fixed to the main body of the gun, one end of the gun chamber is coaxially joined to one end of a gun barrel, a bullet loading opening laterally connects to the gun chamber, and an outer circumference of an end opening of the gun chamber is expanded and equipped with a pressing ring on one direction of the sliding shuttle tube assembly;

an arch returning spring, two ends of the arch returning spring respectively act on the retaining shoulder of the sliding shuttle tube and a corresponding end of the pressing ring of the gun chamber;

the air gun firing operating system enables a shuttling outer circumferential surface of the sliding shuttle tube to similarly operate as a working shaft disposed to slide on an inner circumference of the gun chamber, and the sliding inner circumferential surface of the sliding shuttle tube enables mounting to slide on the cylindrical outer circumferential surface of the cylinder; the surface of the sliding column fitted in the interior of the sliding shuttle tube is slidably plugged the cylinder body of the cylinder, thereby enabling back-and-forth movement of the sliding shuttle tube on an axis between the cylinder and the gun chamber, and the second opening end of the cylinder body is joined to the side surface of the pressure buffer chamber using an intersecting method, thereby enabling the air pressure in the pressure buffer chamber to be rapidly obtained, and sustainably direct a flow of air pressure between the pressure buffer chamber and the channeling portion to achieve an automatic continuous firing operation;

a trigger device which interferes with movement of the sliding shuttle tube is installed in a motion path of the sliding shuttle tube, wherein the trigger device comprises:

a trigger, wherein an upper end of the trigger to the gun body by means of a pin;

a sliding retainer, wherein a body of the sliding retainer is fastened to the gun body by means of a pin, one end of the sliding retainer is repelled by a trigger repulsion, and the other end of the sliding retainer clamps a retaining shoulder of the sliding shuttle tube;

a pulling spring, wherein one end of the pulling spring backward pulls the sliding retainer, and the other end of the pulling spring is fixed to the gun body.

2. The air gun firing operating system according to claim 1, wherein an exterior of one side of a section of the interpassage flow path is fitted with an overpressure protection device.

3. The air gun firing operating system according to claim 2, wherein a cam is pivotal disposed on the gun body by means of a pin, a radial surface of a periphery of the cam is provided with a single firing give way notch, and after changing angular position, the cam is provided with a continuous firing retaining surface.

4. The air gun firing operating system according to claim 1, wherein the cam is pivotal disposed on the gun body by means of a pin, a radial surface of a periphery of the cam is provided with a single firing give way notch, and after changing angular position, the cam is provided with a butt retaining convex protrusion.

5. The air gun firing operating system according to claim 1, wherein the cam is pivotal disposed on the gun body by means of a pin, a radial surface of a periphery of the cam is provided with a single firing give way notch, and after changing angular position, the cam is provided with a continuous firing retaining surface.

* * * * *